US010570688B2

(12) United States Patent
Rose

(10) Patent No.: US 10,570,688 B2
(45) Date of Patent: Feb. 25, 2020

(54) CASING HANGER ASSEMBLY

(71) Applicant: James A. Rose, Murrysville, PA (US)

(72) Inventor: James A. Rose, Murrysville, PA (US)

( * ) Notice: Subject to any disclaimer, the term of this patent is extended or adjusted under 35 U.S.C. 154(b) by 0 days.

(21) Appl. No.: 14/933,184

(22) Filed: Nov. 5, 2015

(65) Prior Publication Data

US 2016/0222768 A1 Aug. 4, 2016

Related U.S. Application Data

(63) Continuation-in-part of application No. 14/612,007, filed on Feb. 2, 2015, and a continuation-in-part of application No. 14/612,216, filed on Feb. 2, 2015.

(51) Int. Cl.
*E21B 43/10* (2006.01)
*E21B 33/04* (2006.01)

(52) U.S. Cl.
CPC ..... *E21B 33/04* (2013.01)

(58) Field of Classification Search
CPC ..... E21B 33/04; E21B 17/046; E21B 19/02; E21B 43/10; E21B 33/0422
USPC ..... 166/77.51
See application file for complete search history.

(56) References Cited

U.S. PATENT DOCUMENTS

2003/0051878 A1* 3/2003 DeBerry ..... E21B 7/12 166/348
2005/0056419 A1* 3/2005 Hosie ..... E21B 33/0407 166/250.01
2006/0254778 A1* 11/2006 Nobileau ..... E21B 17/08 166/380
2008/0017383 A1* 1/2008 Minassian ..... E21B 17/1007 166/338
2013/0092397 A1* 4/2013 He ..... E21B 33/13 166/382

* cited by examiner

*Primary Examiner* — Taras P Bemko
(74) *Attorney, Agent, or Firm* — David G. Oberdick

(57) ABSTRACT

The present invention relates generally to a well casing hanger system that provides for orientation of a hanger with respect to a landing ring during installation. The landing ring has a mating feature, such as a recess, adapted to engage with a mating feature, such as a protrusion, on the casing hanger. The shape of the mating features of the landing ring and hanger is such that rotation to a specific alignment will occur during installation if there is an initial rotational offset.

7 Claims, 9 Drawing Sheets

CASING HANGER ASSEMBLY

CROSS-REFERENCE TO RELATED APPLICATIONS

This application is a continuation-in-part of U.S. application Ser. No. 14/612,007, filed Feb. 2, 2015, and also a continuation-in-part of U.S. application Ser. No. 14/612,216, filed Feb. 2, 2015, both of which are incorporated by reference herein in their entirety.

STATEMENT REGARDING FEDERALLY SPONSORED RESEARCH

Not applicable.

BACKGROUND OF THE INVENTION

The present invention is directed to a casing hanger assembly for use with containment well cellars of the types described and claimed in U.S. Pat. Nos. 7,637,692, 7,987,904, 8,127,837, 8,256,505, and 8,485,250 each of which is hereby incorporated by reference.

The containment well cellars described and claimed in the above noted patents are becoming increasingly recognized for their environmentally-friendly features, as well as for their advantages in well installation and operation. It is among the objects of the present invention to provide accessorial equipment which will further enhance the advantages of this family of sealed well cellars. It will be understood that the features of this invention may be equally of value when employed with other existing and as-yet-to-be-developed well cellars, or simply to hang casing in applications where a well cellar is not being used.

Currently in the industry, casing hangers, both the mandrel and slip types, are used to suspend the weight of a second inner casing on a first outer well casing. This may be done before or after the inner well casing is cemented in place. Existing casing hangers are a part of the wellhead assembly. Typically, when weight in the form of the blow-out-preventer (BOP) or wellhead assembly is attached to the inner casing and, thereby, supported by the partially cured cement, this weight, in conjunction with vibrations associated with the drilling operations, will cause shifting of the well casings and cracking of the cement. This breaks containment allowing migration of well fluids into the area around the wellhead, which contaminates the soil and can pollute the riparian ground water.

In addition, well operators often have a need to position the surface casing in a particular rotational orientation during installation. For example, in some situations the operator must turn the casing so that piping or valves attached to the surface casing are aligned with outlets on the well cellar or other piping installed at the well site. While the heavy machinery used to install the casing provides control in the vertical direction, it does not provide the ability to control the rotation of the casing as it is lowered into position. It would therefore be advantageous to develop a casing hanger system that causes rotation of the inner casing as it is lowered into a conductor pipe or outer casing, securing the casing in a preferred rotational orientation.

BRIEF SUMMARY OF THE INVENTION

According to embodiments of the present disclosure is a casing hanger system that provides for orientation of a casing during installation. More specifically, the casing hanger system comprises a landing ring having a feature, such as a recess in the preferred embodiment, configured to mate with a complementary feature, such as a protrusion, on a casing hanger. Unlike existing hanger systems, the casing hanger of the present invention is not part of the well head assembly. Further, a portion of the casing hanger system of the present invention may be attached to the floor of one of the well cellars described in the above noted patents distributing the weight of the well casings, any attached equipment, and associated drilling forces, over the area of the floor. This inhibits settling of the inner and outer well casings and ensures the cement remains intact for the life of the well so that migration of well gases and other fluids leading to contamination of the ground water and soil surrounding the well head is avoided.

A first aspect of the present invention comprises a well completion system including a) a sealed well cellar embedded in a region surrounding a well site, the sealed well cellar collecting well fluids and preventing the fluids from polluting the region surrounding the well site; b) a surface casing hanger secured to a floor portion of the sealed well cellar, the floor portion having a first area, the casing hanger distributing a weight supported by the casing hanger over said first area; c) a surface casing extending through the surface casing hanger and being secured thereto. In one embodiment, the surface casing hanger is welded to an external portion of the surface casing. Alternatively, the surface casing hanger is threaded onto an upper threaded portion of said surface casing. Preferably, the surface casing hanger is secured to a landing ring which is secured to an upper portion of a conductor pipe through which the surface casing extends.

In a preferred embodiment, the casing hanger has a protrusion that mates with a recess on the landing ring, such that the casing hanger can only be seated on the landing ring in one particular orientation. Moreover, the protrusion and recess are shaped so that engagement of the protrusion within the recess causes rotation of the surface casing if not initially aligned properly with respect to the outer casing. The landing ring may additionally include lock down means to which the hanger is secured preventing the surface casing from being pushed upwardly by buoyancy or hydraulic forces.

In a further aspect of the present invention, a well completion system comprises: a) a landing ring secured to an upper region of a conductor pipe, as by welding; b) a surface casing hanger which engages and is supported by the landing ring; c) a surface casing attached to and supported by the surface casing hanger. The well completion system may further include a sealed well cellar having a floor portion and upwardly extending walls, the floor portion of the sealed well cellar being attached to and supporting a weight of the surface casing hanger as well as a weight of the surface casing which is attached thereto. In one embodiment, the surface casing hanger is welded to an external portion of said surface casing. Alternatively, the surface casing hanger may be threaded onto an upper threaded portion of the surface casing. The landing ring may be equipped with a quick-connect fitting to receive a riser.

A third aspect of the present invention is directed to a method of completing a well comprising the steps of a) installing a conductor pipe; b) install a well cellar having a structural, load-bearing floor portion surrounding the conductor pipe; c) securing the well cellar to the conductor pipe; d) installing a landing ring by securing the landing ring to one of i) the conductor pipe and, ii) the cellar floor. The method may include the additional step of attaching a riser to an upper end of the landing ring using a quick connect profile which readily receives the riser and secures the riser thereto. The method may additionally comprise the steps of i) drilling a surface hole through the riser and ii) installing a surface casing with a surface casing hanger secured to an uppermost section of pipe by landing the surface casing hanger on the landing ring. The invention includes the further step of cementing the surface casing in place by pumping cement through the surface casing with adequate pressure to force the cement down through the surface casing and upwardly around an external surface portion of the surface casing. Finally, the steps of i) draining said riser; ii) removing said riser; and, iii) securing a well head to the surface casing are performed.

Various other features, advantages, and characteristics of the present invention will become apparent after a reading of the following detailed description.

BRIEF DESCRIPTION OF THE SEVERAL VIEWS OF THE DRAWINGS

The preferred embodiment(s) of the present invention is/are described in conjunction with the following drawings in which like features are indicated with like reference numerals.

DETAILED DESCRIPTION OF THE INVENTION

Figure 1:
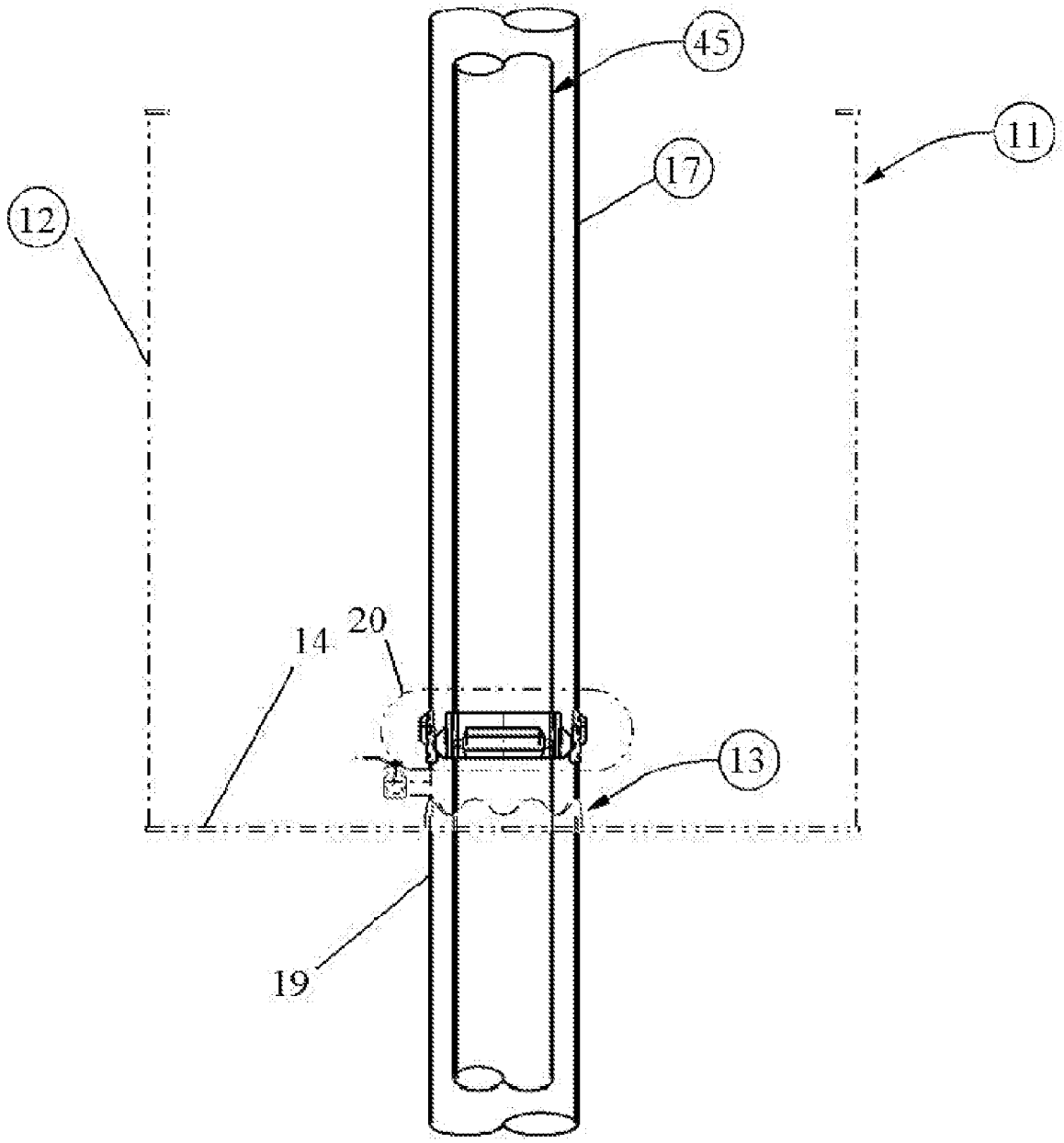
FIG. 1 is a front schematic of a first embodiment of the casing hanger system of the present invention.

A first embodiment of the casing hanger assembly of the present invention is depicted in FIGS. 1-3C generally at 20. The environment in which casing hanger assembly 20 is most preferably utilized is depicted in FIG. 1 and includes a sealed containment well cellar 11 of the types disclosed in U.S. Pat. Nos. 7,637,692, 7,987,904, 8,127,837, 8,256,505, and 8,485,250. While any of these containment cellars may be used, the specific type depicted in FIG. 1 is the cellar featuring a riser with a scalloped upper edge 13 described and claimed in U.S. Pat. No. 8,485,250. Containment well cellar 11 has a horizontal floor 14 and a vertically extending wall 12 sealingly attached thereto, as by welding, for example. FIG. 1 depicts inner casing 45 being installed through detachable upper riser 17. It will be understood, however, that the casing hanger assembly 20 of the present invention may be utilized in applications which do not utilize a well cellar, such as when a separate base plate is used or the conductor provides sufficient support for the casing 45 without the need for a well cellar.

Figure 2A:
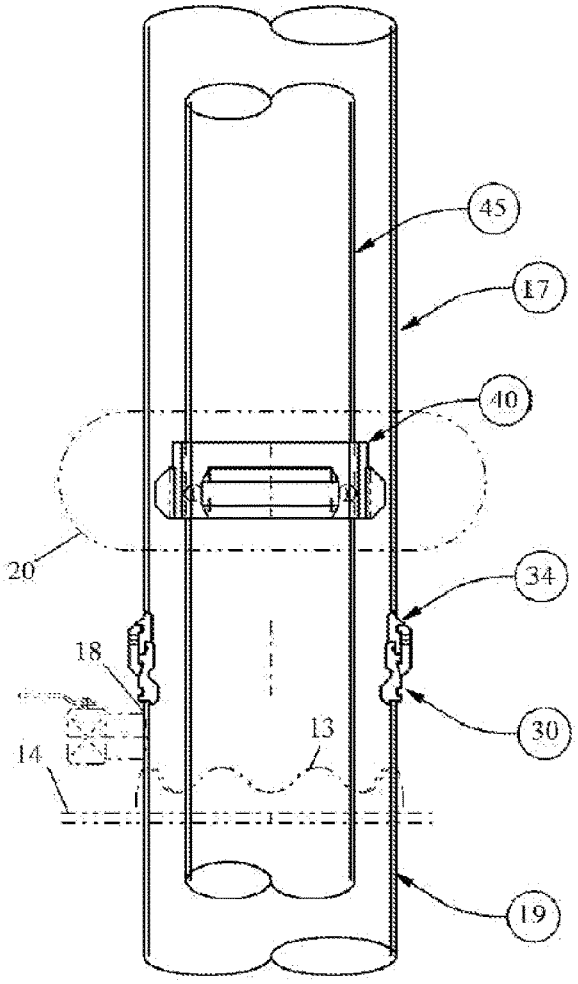
FIG. 2A is an enlarged schematic view of the casing hanger system shown in FIG. 1 as the inner casing is being installed.
Figure 2B:
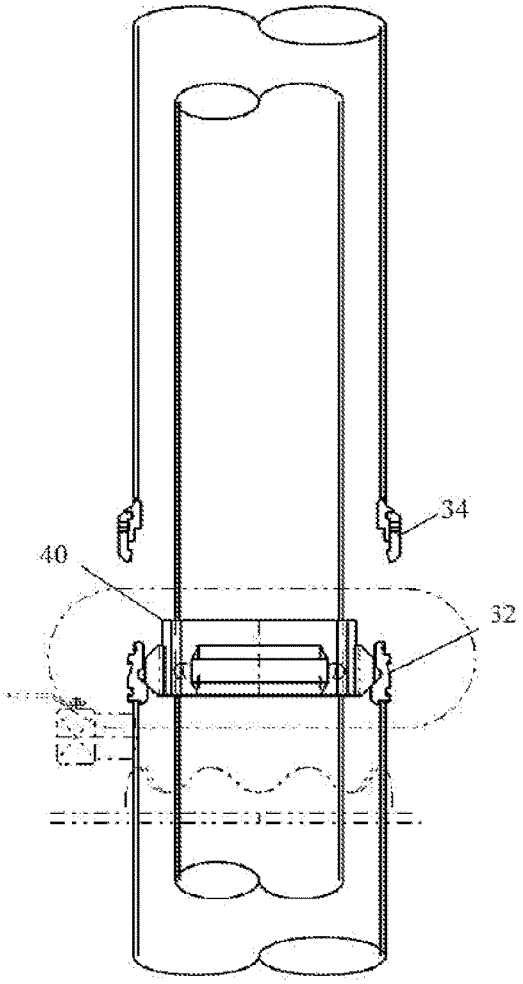
FIG. 2B is a view similar to FIG. 2A showing the inner casing fully seated and the riser released.
Figure 2C:
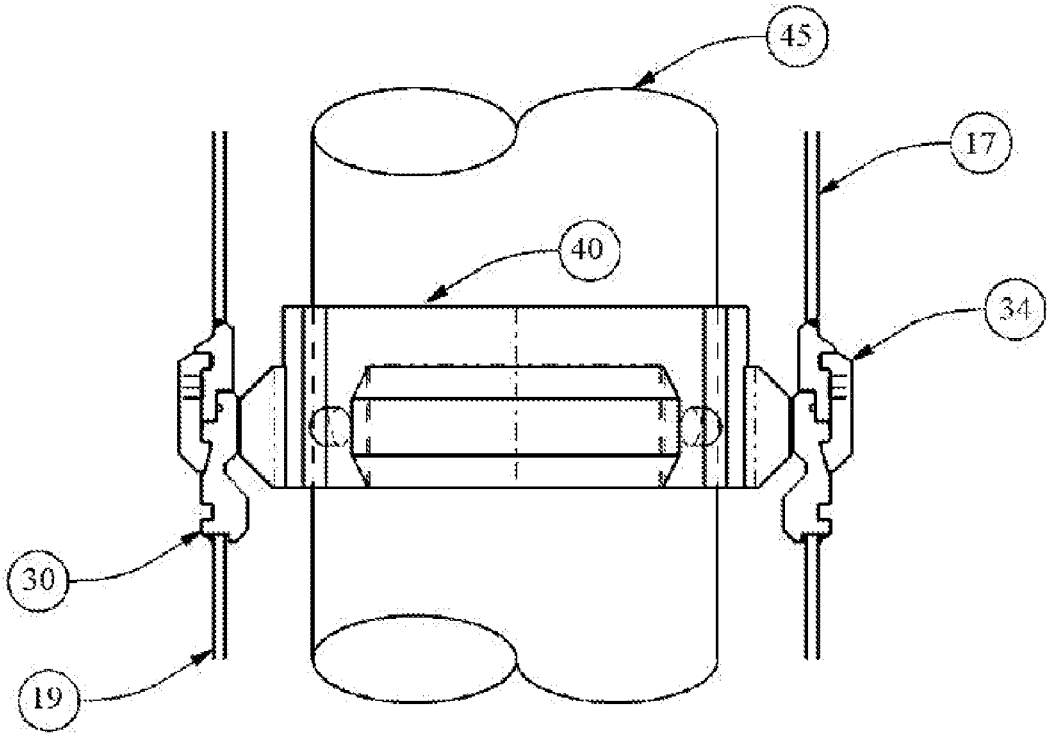
FIG. 2C is an enlarged detailed view showing the inner casing approaching the FIG. 2B position.
Figure 2D:
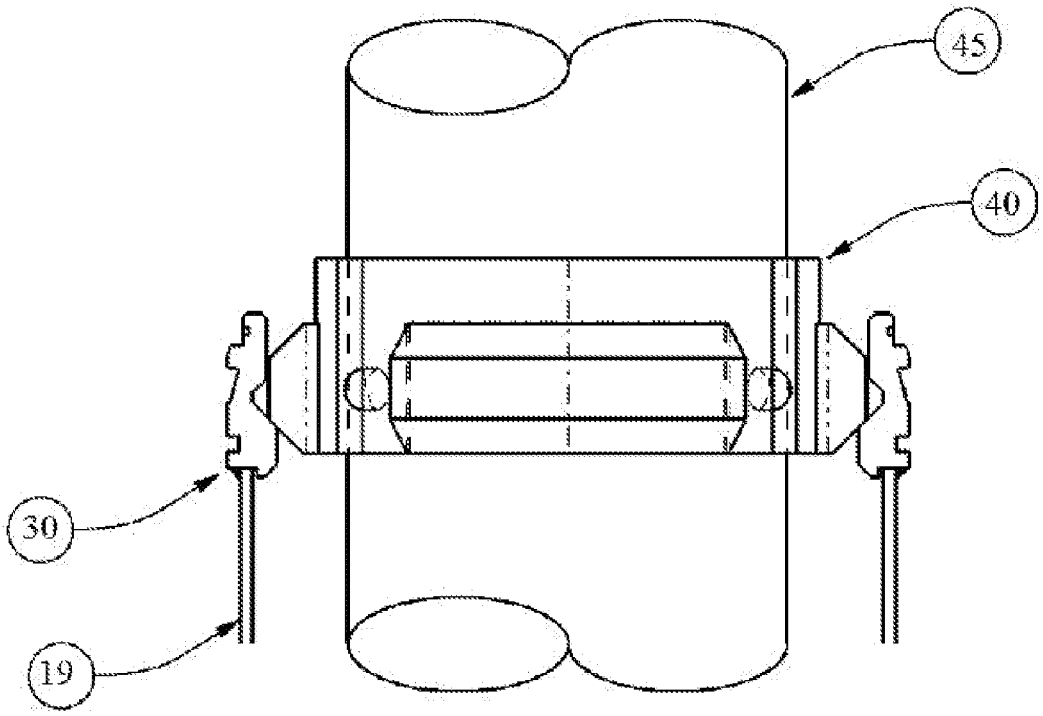
FIG. 2D is an enlarged detailed view showing the inner casing in the fully seated FIG. 2B position.

The casing hanger assembly 20 of the present invention is depicted in greater detail in FIGS. 2A-D. Casing hanger assembly 20 includes landing ring 30 and hanger 40. Landing ring 30 is secured as by welding to either the floor 14 of well cellar 11 or to the outside of the conductor pipe 19, which is, in turn, welded to the floor 14. As seen in FIG. 2A-2E, landing ring 30 is welded to the upper end 18 of conductor pipe 19. In this embodiment, landing ring 30 includes a quick connect feature 32 permitting upper riser 17 to be easily engaged and disengaged therefrom (FIGS. 2A, 2B). Riser 17 has element 34 welded to a lower end thereof which mates with quick connect feature 32.

Surface casing 45 has casing hanger 40 welded to an external surface thereof. The casing hanger will typically be welded to the last (upper) section of surface casing 45. Both securement of landing ring 30 to cellar floor 14 or conductor pipe 19 and of hanger 40 to the upper section of surface casing 45, can be performed in the shop before transporting to the field for installation, although, more typically, this step will be performed in the field. Welding in the shop may ensure a better quality weld in a more controlled environment. As depicted in FIGS. 2A-2D, surface casing 45 with casing hanger 40 welded thereto is inserted through detachable upper riser 17 until hanger 40 moves from the position shown in FIG. 2C to that depicted in FIG. 2D, fully seated and engaged in landing ring 30.

Figure 3A:
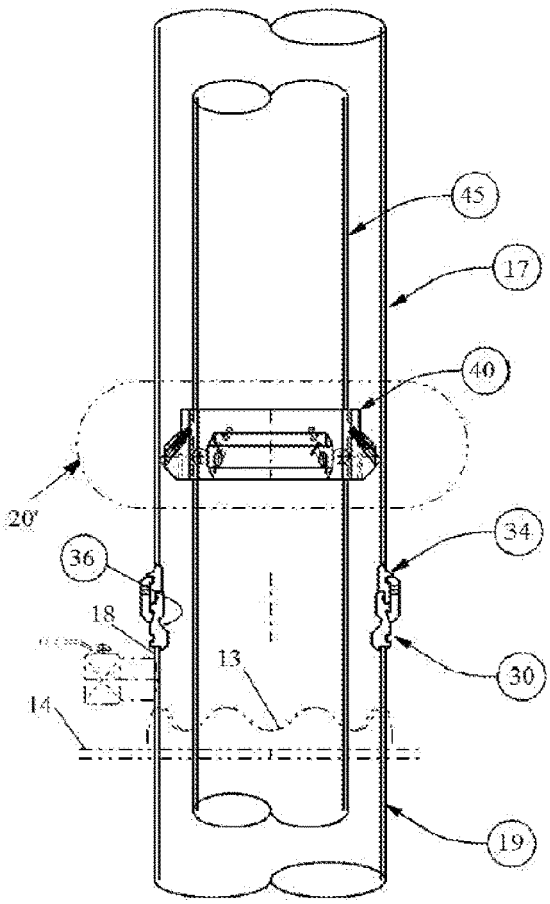
FIG. 3A is an enlarged schematic view of the casing hanger system as the inner casing is being installed.
Figure 3B:
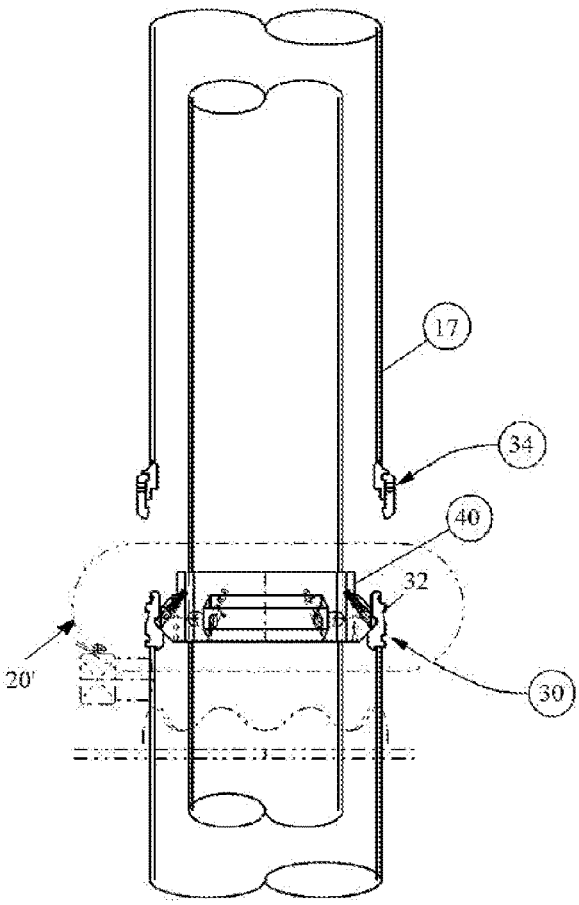
FIG. 3B is a view similar to FIG. 3A showing the inner casing fully seated and the riser released.
Figure 3C:
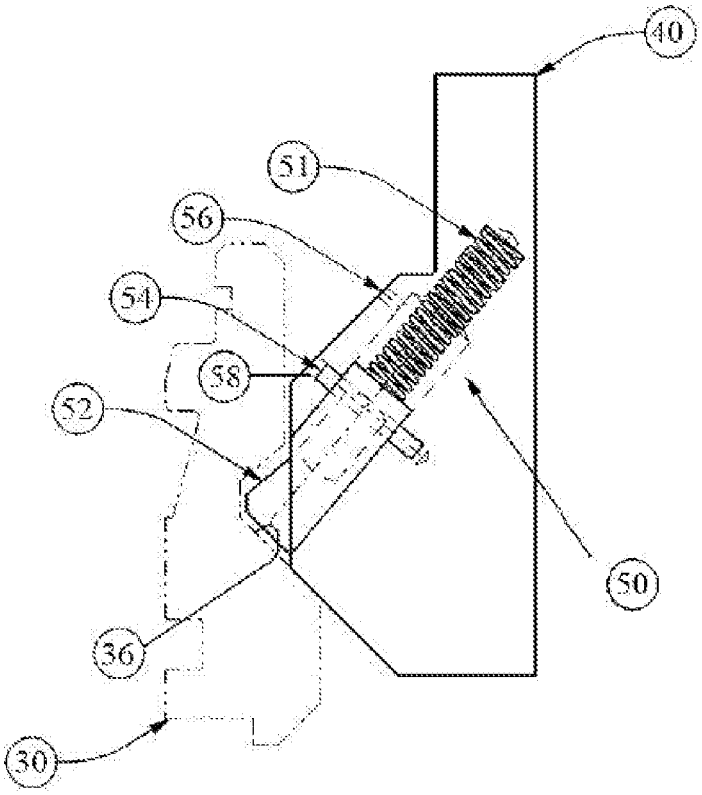
FIG. 3C is an enlarged detail of the locking mechanism used with this embodiment shown in ellipse 20' of FIG. 3B.

One alternative embodiment of casing hanger assembly 20' shown in FIGS. 3A-3C is equipped with a lock down feature 50. All remaining features of this second embodiment are the same as those of the first. Spring 51 biases lock down stud 52 into recess 36 in landing ring 30. Lock down feature 50 prevents the dangerous upward movement of surface casing 45 due to hydraulic and/or buoyancy forces within the well. Without the lock down feature 50, surface casing 45 can be forced upwardly out of engagement with the landing ring 30.

Figure 4A:
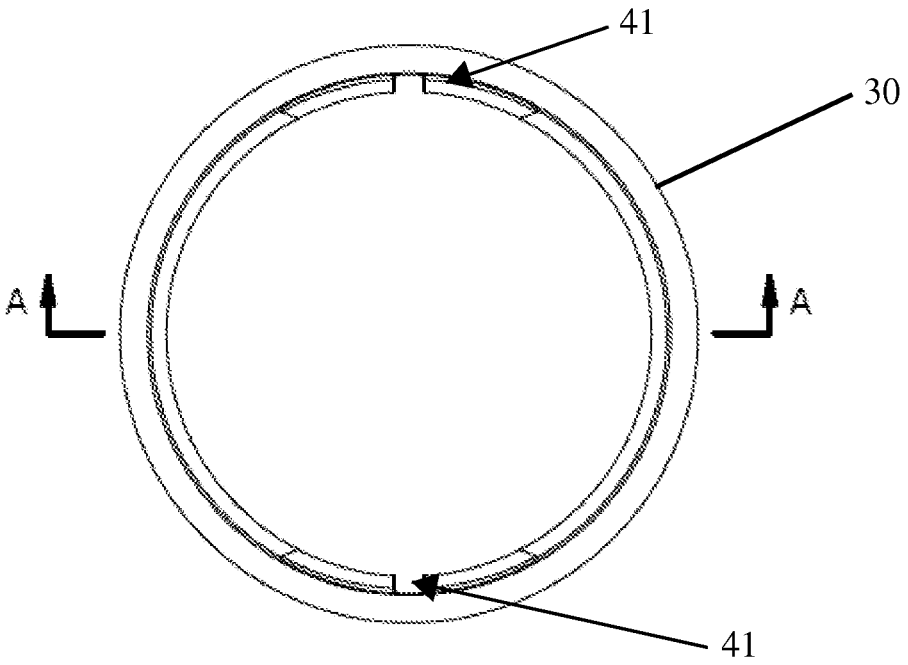
FIGS. 4A and 4B are views of the orienting landing ring according to an alternative embodiment of the casing hanger system.
Figure 4B:
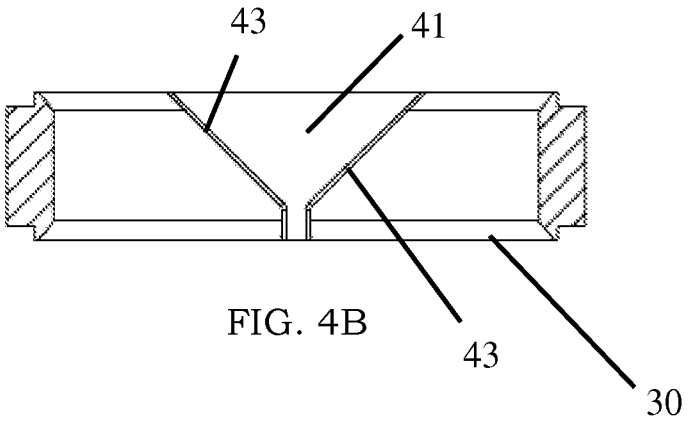

In yet another alternative embodiment of the present invention, the hanger 40 and landing ring 30 are provided with complementary mating features 41 and 42 that cause the surface casing 45 to align in a particular orientation relative to the landing ring 30 (which has been installed in a desired orientation) as it is being lowered into position. FIGS. 4A and 4B depict the landing ring 30 according to one particular embodiment. As shown in FIG. 4A, the mating feature of the landing ring 30 is a recess 41 disposed on opposing sides of an interior surface of the annular landing ring 30. While two recesses 41 are shown in this particular embodiment, a single or several recesses 41 can be used.

Figure 5A:
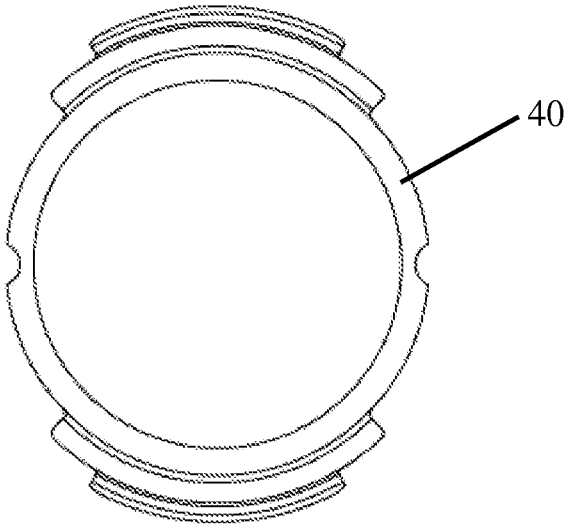
FIGS. 5A and 5B are views of the orienting casing hanger, which has a complementary shape to the orienting landing ring.
Figure 5B:
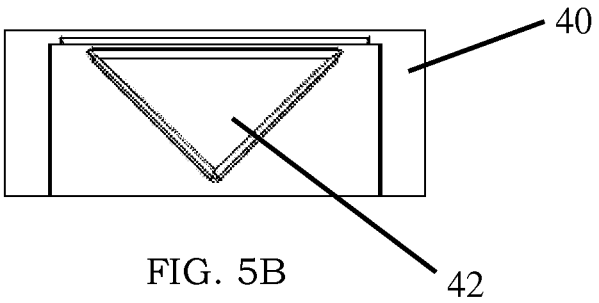

FIG. 4B is a cross-sectional view of the landing ring 30 and shows the shape of the recess 41, which tapers along a longitudinal direction. That is, the recess 41 has a wider profile at its top and tapers to a narrower profile at its bottom. The shape of the recess 41 facilitates alignment of the hanger 40 within the landing ring 30 during installation. For example, FIGS. 5A and 5B show the mating feature of hanger 40 as a protrusion 42 having a similar tapered shape and adapted to be seated within the recess 41 of the landing ring 30 depicted in FIGS. 4A and 4B.

During installation, as surface casing 45 with hanger 40 is lowered into position inside of outer casing 19 with landing ring 30, the bottom portion of protrusion 42 will begin to engage recess 41. If the two are not aligned, the bottom portion of protrusion 42 will contact a side 43 of recess 41. Because of the tapered shape of recess 41, continued lowering of the surface casing 45 will cause the casing 45 to rotate as the protrusion 42 slides along the side 43 of the recess 41 and towards the center of the recess 41. A person having skill in the art will appreciate that alignment will occur only if the bottom portion of protrusion 42 is initially positioned within the width of the top profile of the recess 41. As such, the width of the top profile can be specified depending on the level of rotation likely needed in the field.

While a triangle shaped protrusion 42 and recess 41 are shown by way of example in FIGS. 4A, 4B, 5A, and 5B, other profiles that facilitate alignment during engagement can be used. Additional examples include a profile where the mating features have one engaging side 43 (i.e. a ramp), or a profile where opposing sides 43 of the recess 41 are not parallel to the longitudinal axis of the conductor pipe 19 and tend to converge at a center point at the bottom of the recess 41, whether curved or straight. In these examples, the protrusion 42 would have a complementary shape to the recess 41. For example, if the landing ring 30 had a ramp, the casing hanger 40 could have a ramp oriented in the opposite direction. In addition, the mating features 41 and 42 may or may not comprise the weight bearing portion of the landing ring 30. If the recess 41 does not provide weight bearing functionality, other surfaces of the landing ring 30 can provide this feature. Thus, it is only necessary that the shape of the mating features allow orientation of the components.

Figure 6:
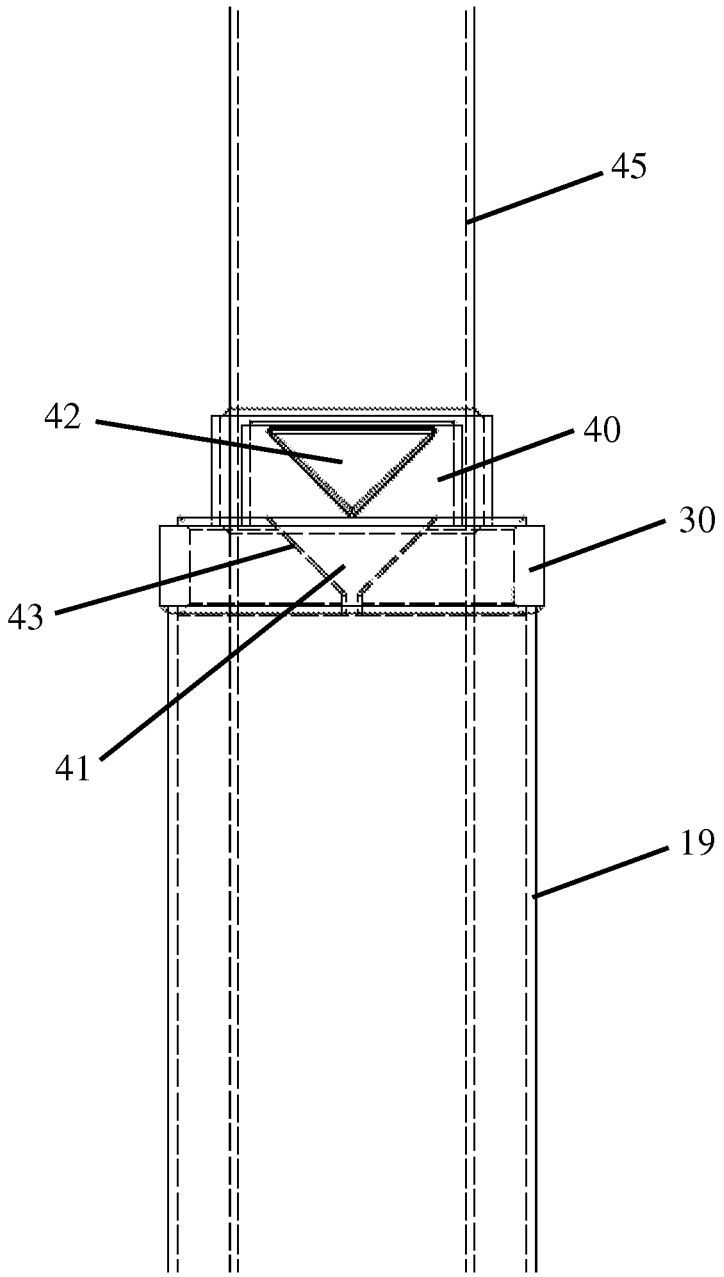
FIG. 6 shows the casing hanger installed on an inner casing and aligned with the orienting landing ring installed on an outer casing.
Figure 7:
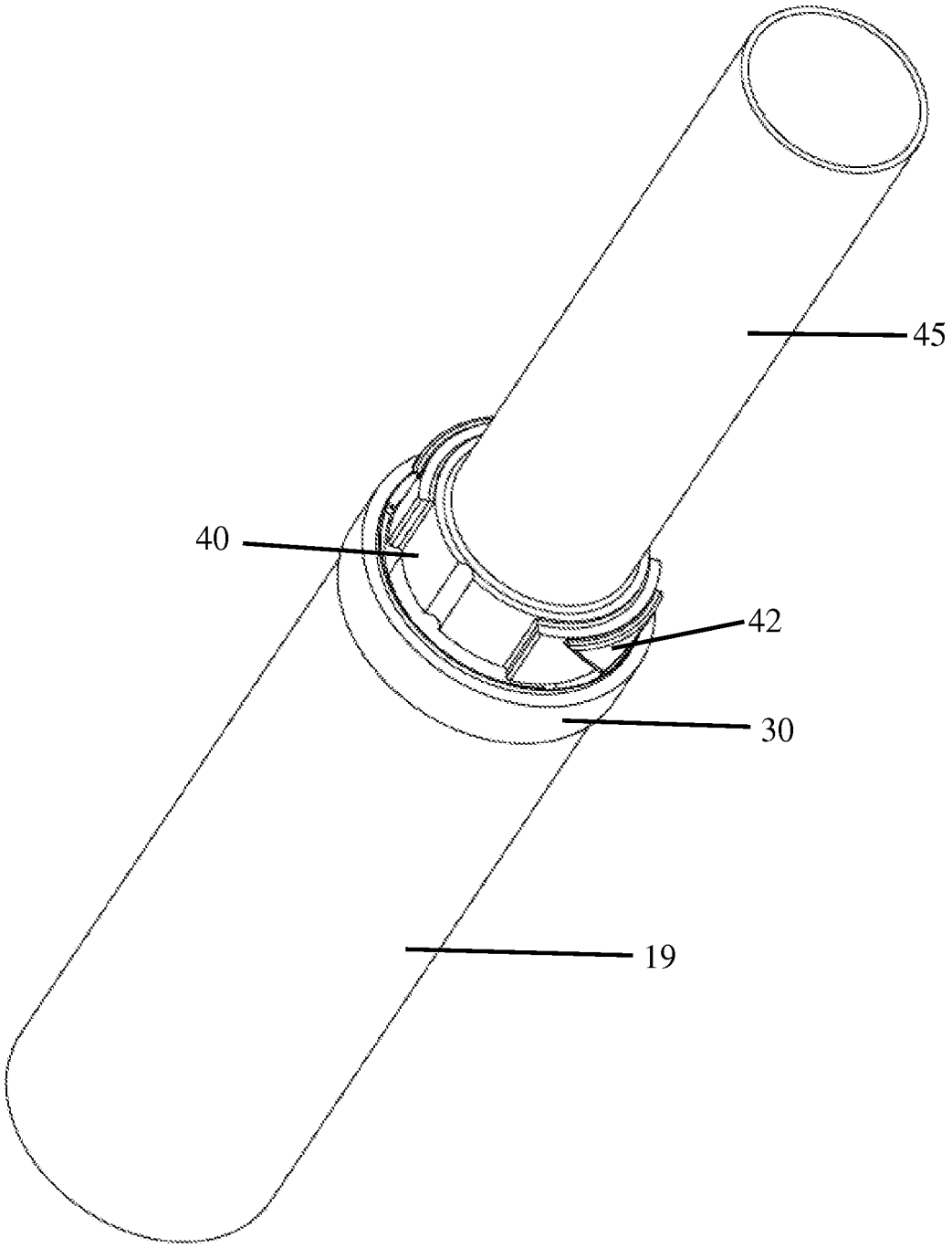
FIG. 7 shows an alternate view of the orienting landing ring and casing hanger installed on their respective casings.

FIG. 6 shows the position of hanger 40 relative to landing ring 30 during installation but prior to engagement of the two components. Since the protrusion 32 is shaped to seat securely within recess 41, the hanger assembly system 20 provides weight-bearing functionality. In addition, once properly mated, the inner casing 45 is maintained in a specific orientation relative to the outer casing 19. If multiple recesses 41 are provided on the landing ring 30, the casing 45 can occupy one of multiple orientations. However, this orientation is discrete and will not change once the hanger 40 is seated in the landing ring 30. Thus, the orienting casing hanger assembly 20 provides another advantage in instances where addition work on the well is performed before the cement between the outer 19 and inner 45 casing is fully cured. FIG. 7 shows an alternative view of the casing hanger system 20 prior to engagement of the hanger 40 in the landing ring 30.

In performing the method of installation, the conductor pipe 19 is installed in a conventional manner by sliding into a drilled hole or being driven into the ground to create the well hole. If a containment cellar is to be used, then containment well cellar 11 is installed as described in the manner taught in the above cited earlier patents, which may vary depending on the type of cellar utilized. Cellar 11 is fastened, by welding for example, to conductor pipe 19. Landing ring 30 is secured, as by welding, to either the floor 14 of cellar 11 or to conductor pipe 19. In a cellarless installation, the landing ring 30 will be welded, or otherwise secured, to the conductor pipe 19. The drilling rig (not shown) may be assembled and positioned in a conventional manner.

Then, the riser 17 with element 34 is secured to quick connect feature 32 on landing ring 30. The drilling rig is utilized to drill the surface hole with the surface casing 45 being run into the hole after drilling. The last joint of surface casing 45 with casing hanger 40 secured thereto is run into the hole and hanger 40 seated on landing ring 30. Cement is pumped down the interior of the surface casing 45 with adequate pressure to force the cement emerging from the end of casing 45 to migrate upwardly around the exterior of the casing 45, cementing it in place. The riser 17 is drained and element 34 unlatched/detached from quick connect feature 32. The wellhead and BOP, etc., is secured and normal well activities are initiated. When the quick connect/disconnect feature 32 is not utilized, landing ring 30 can be welded to conductor 19 and riser 17.

The well construction system solves a significant problem with existing wells. A survey of over 100 wells in Pennsylvania and West Virginia found that over 9% of wells had gas migration problems. It was presumed that this resulted from shifting occurring while the cement was not fully set, due in part to the weight of the surface well casing and in part to the weight of the wellhead, BOP, etc. being suspended prior to the cement fully curing. Additionally, vibration associated with drilling activities exacerbates cement bonding damage. The use of the casing hanger assembly 20 permitted the distribution of this weight over the area of the load-bearing floor portion such that no shifting of the surface casing occurred after the cementing step. In the 30+ well installations employing the casing hanger assembly 20 of the present invention, none suffered gas migration. This eliminates the risk of polluting the riparian streams, aquifers, etc., and allows production to be initiated without waiting for the cement to fully cure, enhancing profitability of the well.

Various changes, alternatives, and modifications will become apparent to a person of ordinary skill in the art after a reading of the foregoing specification. It is intended that all such changes, alternatives, and modifications as fall within the scope of the appended claims be considered part of the present invention.

What is claimed is:

1. A well casing hanger assembly for coupling and orienting a second well casing to a first well casing or a well cellar, the assembly comprising:

a landing ring for attachment to a first well casing, conductor pipe or a well cellar, the landing ring having a first feature that tapers along a longitudinal axis; and a casing hanger for attachment to an external surface of a second well casing, the casing hanger having a second feature that tapers along a longitudinal axis;

wherein the second feature is configured to mate with the first feature whereby downward movement of the casing hanger causes the second feature to contact and mate with the first feature and continued downward movement of the casing hanger causes a rotational interaction between the mated first feature and second feature and resulting movement and alignment of the casing hanger in a predetermined orientation with respect to the landing ring.

2. The well casing hanger assembly of claim 1, wherein the second feature is complementary in size and shape to the first feature.

3. The well casing hanger assembly of claim 1, wherein the first feature has a side that is not parallel to a longitudinal axis of the first well casing.

4. A well casing hanger assembly for coupling and orienting a second well casing to a first well casing or a well cellar, the assembly comprising:

a landing ring for attachment to a first well casing, conductor pipe or a well cellar, the landing ring having a first feature that comprises a recess on an inner surface of the landing ring; and a casing hanger for attachment to an external surface of a second well casing, the casing hanger having a second feature that comprises a protrusion extending outwardly from an exterior surface of the casing hanger; wherein the second feature is configured to mate with the first feature whereby downward movement of the casing hanger causes the second feature to contact and mate with the first feature and continued downward movement of the casing hanger causes a rotational interaction between the mated first feature and second feature and resulting movement and alignment of the casing hanger in a predetermined orientation with respect to the landing ring.

5. The well casing hanger assembly of claim 4, wherein the protrusion fully seats within the recess, thereby providing a weight bearing surface.

6. The well casing hanger assembly of claim 4, wherein the protrusion and recess are triangular in shape.

7. A well casing hanger assembly for coupling and orienting a second well casing to a first well casing or a well cellar, the assembly comprising:

a landing ring for attachment to a first well casing, conductor pipe or a well cellar, the landing ring having a first feature;

a casing hanger for attachment to an external surface of a second well casing, the casing hanger having a second feature; and a plurality of features disposed on the landing ring, wherein each of the plurality of features are complementary in size and shape to the second feature, so that when the casing hanger is advanced towards the landing ring, the second feature engages the first feature or one of the plurality of features, thereby causing alignment of the casing hanger relative to the landing ring in one of several discrete rotational orientations;

wherein the second feature is configured to mate with the first feature whereby downward movement of the casing hanger causes the second feature to contact and mate with the first feature and continued downward movement of the casing hanger causes a rotational interaction between the mated first feature and second feature and resulting movement and alignment of the casing hanger in a predetermined orientation with respect to the landing ring.

* * * * *